United States Patent [19]

Schlicht

[11] Patent Number: 4,525,288

[45] Date of Patent: Jun. 25, 1985

[54] LUBRICANTS CONTAINING HYDROXYALKOXY ACID AMIDES OF ALKYL AMINES AS FRICTION REDUCERS

[75] Inventor: Raymond C. Schlicht, Fishkill, N.Y.

[73] Assignee: Texaco Inc., White Plains, N.Y.

[21] Appl. No.: 523,242

[22] Filed: Aug. 15, 1983

[51] Int. Cl.[3] ..... C10M 1/32

[52] U.S. Cl. ..... 252/32.7 E; 252/51.5 A

[58] Field of Search ..... 252/51.5 A, 32.7 E; 260/404; 564/201, 170

[56] References Cited

U.S. PATENT DOCUMENTS 3,232,988 2/1966 Sexsmith et al. ..... 564/201
3,250,719 5/1966 Schmolka et al. ..... 564/201 X
3,781,218 12/1973 Suzuki et al. ..... 564/201 X
4,195,096 3/1980 Graham et al. ..... 564/201 X

OTHER PUBLICATIONS

Chem. Abstracts, vol. 88, (1978), 154,776m, Krause et al.

*Primary Examiner*—Andrew H. Metz
*Attorney, Agent, or Firm*—Robert A. Kulason; James J. O'Loughlin

[57] ABSTRACT

N-alkyl-substituted-hydroxyalkoxyacid amides are prepared by the reaction of a p-dioxanone or of corresponding acyclic analog or higher homologs with a primary or secondary aliphatic amine or by the oxyalkylation of the alcohol functions(s) of certain hydroxy acid amides.

2 Claims, No Drawings

LUBRICANTS CONTAINING HYDROXYALKOXY ACID AMIDES OF ALKYL AMINES AS FRICTION REDUCERS

BACKGROUND OF THE INVENTION

1. Field

The present invention relates to the field of organic chemistry and is directed more particularly to novel hydroxyalkoxyacid amides and to methods of making same. In particular the invention discloses 2'-hydroxyethoxyacetamides of certain alkyl amines.

2. Patent Information Disclosure Statement

Previously issued patents and the literature evidence little activity in this class of compounds. However, U.S. Pat. No. 4,195,096 discloses as fungicides amides of the general formula:

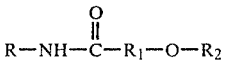

wherein R is an organic radical of from 4 to 20 carbon atoms, $R_1$ is alkylene of from 1 to 6 carbon atoms and $R_2$ is alkyl of from 1 to 6 carbon atoms substituted with a hydroxy group. Also noteworthy but less relevant are U.S. Pat. Nos. 2,426,855; 2,520,551 and 2,969,323.

SUMMARY OF THE INVENTION

The present invention provides a new class of hydroxyalkoxy acid amides represented by the formula:

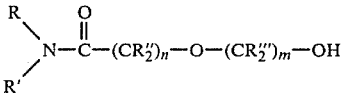

where R is a fatty alkyl, alkenyl, or a poly-unsaturated alkyl radical having about 12 to about 30 essentially linear carbon atoms; R', R'', or R''' may be hydrogen, R, or other alkyl or aryl group having from about 1 to about 30 carbon atoms; R', R'', R''' may be the same substituent or any combination of the above substituents, m=1-10 and n=1-10.

Preferred compounds are those where R is a straight chain alkyl radical of from about 12 to 18 carbon atoms, R' is hydrogen or an alkyl radical of 1 to 18 carbon atoms and R'' and R''' are hydrogen, m=2 and n=1. R', R'' and R''' can be alkyl or aryl groups bearing other substituents such as OH, halogen, nitro, nitrile, tertiary amino, acyloxy, and carbalkoxy, which do not alter the predominantly hydrocarbon nature of the radical.

These compounds are hydrogen—soluble or at least stably dispersible in such medium to an extent which allows them to function in their intended manner. These compounds find utility in fuels and lubricants as friction reducers.

The present invention also provides convenient methods for preparing the above compounds.

In a preferred method, one or more primary or secondary aliphatic amine (I) is reacted with a para-dioxanone (II). The reaction is exothermic but certain reactants preferably are heated under an inert (nitrogen) atmosphere until the analysis of samples indicates a decrease in Total Base Number to essentially 0. Where needed as in the case of the reactants being solids or extremely viscous liquids, solvents inert to the reactant can be used.

The reaction proceeds as follows:

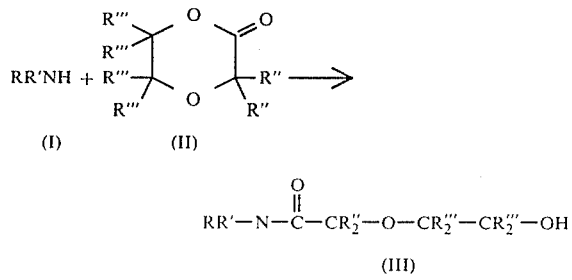

where R, R', R'' and R''' are as above defined. Paradioxanones (II) are obtained in manner known to this art such as by oxidation of p-dioxanes, using such oxidants as $H_2O_2$, chromic acid, potassium permanganate, and aqueous nitric acid.

A second modification of the method illustrated uses acyclic acid analogs of the formula:

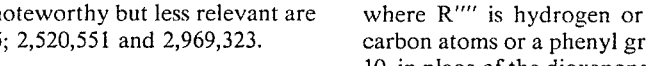

where R'''' is hydrogen or an alkyl radical of 1 to 4 carbon atoms or a phenyl group; and m and n equal 1 to 10, in place of the dioxanone, with elimination of water, an alcohol, or a phenol.

This reaction proceeds as follows:

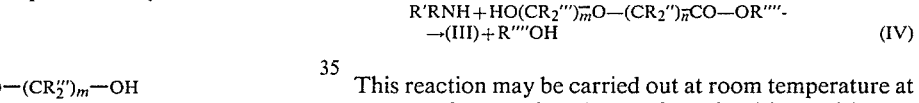

This reaction may be carried out at room temperature at up to 200° C., preferably at 80°-150°, with or without a basic or acid catalyst.

The acyclic acids where R'''' is hydrogen can be prepared by partial oxidation of a dialkylene glycol.

DISCLOSURE OF BEST MODE OF PRACTICING THE INVENTION

Primary amines suitably preferred for the present invention are those wherein R represents an alkyl radical of about 8 to 30 carbons, and preferably from 10 to 18 carbon atoms. Representative amines are those known as aliphatic fatty primary amines and commercially known as ARMEEN primary amines (products produced by Armak Chemicals, Chicago, Ill.). Typical fatty amines include alkyl amines such as n-octylamine (caprylylamine), n-decylamine (caprylamine), n-dodecylamine (laurylamine), n-hexadecylamine (palmitylamine), margarylamine, n-octadecylamine (stearylamine).

Primary amines in which the hydrocarbon chain comprises olefinic unsaturation are also useful. Thus, the R hydrocarbyl radical may contain one or more olefinic unsaturation depending on the length of the chain, usually one or two double bonds per radical. The hydrocarbyl radical can contain up to 30 carbon atoms and preferably from 12 to 18 carbon atoms. Representative amines include dodecenylamine, myristoleylamine, palmitoleylamine, oleylamine, and linoleylamine. Such unsaturated amines are also available under the ARMEEN name.

Also suitable are mixed fatty amines such as Armak's Armeen-C, Armeen-O, Armeen-OL, Armeen-T, Armeen-HT, Armeen S and Armeen SD. Secondary amines include dialkylamines having two of the above alkyl groups including such commercial fatty secondary amines as Armeen 2C and Armeen[2]-HT, and also mixed dialkylamines where R=a fatty amine and R′ may be a lower alkyl group (1–9 carbon atoms) such as methyl, ethyl, n-propyl, i-propyl, butyl, etc., or R′ may be an alkyl group bearing other non-reactive or polar substituents (cyano, alkyl, carbalkoxy, tertiary amino, alkoxy; thioalkoxy, halo, sulfoxide, sulfone) such that the essentially hydrocarbon character of the radical is not destroyed. Also suitable are fatty polyamines diamines, including mono-or dialkyl, symmetrical or asymmetrical, ethylene diamines, propane diamines (1,2 or 1,3), and polyamines analogs of the above. Suitable commercial fatty diamines are "Duomeen C" (N-coco-1,3-diaminopropane), "Duomeen S" (N-soya-1,3-diaminopropane), "Duomeen T" (N-Tallow-1,3-diaminopropane), or "Duomeen O" (N-oleyl-1,3-diaminopropane). "Duomeens" are commercially available diamines described in Product Data Bulletin No. 7-10R1 of Armour Chemical Co. 401 N. Wabash, Chicago, Ill. 60690.

The following examples illustrate in non-limiting fashion the invention.

EXAMPLE 1

This example shows the preparation of N-Oleyl(2′hydroxy)ethoxy acetamide.

A 132.0 g. (0.5 mole) quantity of Armeen OL (a commercial oleylamine) was added to 53.5 g. (0.5 mole) of p-dioxanone (95% purity) prepared by $H_2O_2$-oxidation of p-dioxane). The temperature rose by exothermic reaction to 82°. The mixture was cooled to 60° and stirred 2 hours at 60°. The infra red spectrum indicated that the conversion of the dioxanone carbonyl group to an amide was essentially complete. The yield of product was 184 g. The product analysed as follows:

| | Found | Calculated |
|---|---|---|
| % N | 3.66 | 3.82 |
| TAN | 5.0 | 0 |
| TBN | 3.2 | 0 |

The low basic nitrogen content (TBN=Total Base No.) corresponds to 98% conversion of the amine to amide.

EXAMPLE 2

The example shows the preparation of N,N-Di-n-alkyl-(2′-hydroxy)ethoxyacetamide.

A mixture of 123.0 g. (approximately 0.3 mole) Armeen 2C (a mixed di-n-alkylamine composed largely of di-n-dodecylamine) and 32.1 g. (0.3 mole) p-dioxanone (95% purity) was heated under a $N_2$ atmosphere to 60°. After 2 hours at 60° and subsequently 9 hours at 80°, the reaction mixture still showed a TBN of 41. The mixture was dissolved in toluene and filtered to remove white solids, and the filtrate was stripped of solvent to 100° at 10 min., 738.6 g. was recovered. Then 132.4 g. of this material (TBN about equal to 0.104 Eq. of basic N) was treated with 17.6 g. more dioxanone at 80° for 13 hours, the TBN slowly decreasing to 18. The final reaction mixture was dissolved in n-heptane and filtered, and then stripped of solvent to 80° C. at 10 mm. The final reaction mixture was dissolved in n-heptane and filtered, and then stripped of solvent to 80° at 10 mm. The yield was 127.1 g. The product analyzed as follows:

| | Found | Calculated |
|---|---|---|
| % N | 2.53 | 2.71 |
| TAN | 8.0 | 0 |
| TBN | 18, ch 24 | 0 |

The above TBN value corresponds to about 80% conversion to the desired amide product.

The performance of the Example 1 composition as representative of the friction reducing properties of this class of compounds in an SAE 10W-40 motor oil formulation (A) is given in Table I. The motor oil base blend, containing no friction modifiers, had the following composition:

| Additive | Dose, % Wt. |
|---|---|
| Alkenylsuccinamide dispersant | .08 N |
| Overbased calcium sulfonate | .23 Ca |
| Polyethoxylated alkylphenol | .15 |
| Zinc dialkyldithiophosphate | .15 Zn |
| Diarylamine | .25 |
| Oil conc. of a polymethacrylate | .10 |
| Oil conc. of an olefin copolymer | 11.70 |
| Silicone antifoamant | 15 ppm |

TABLE I

Friction Tests on Oil Blends of Experimental Additives

| Oil | Friction Modifier Ex-No | Friction Modifier Wt. %[1] | Small Engine Friction Test (Δ Friction, %)[2] |
|---|---|---|---|
| A | None | | 0 ± 3 |
| B | I | 0.5 | −14.6 |
| C | Commercial friction modifier | 0.5 | −11.9 |

[1]Amounts added to the base formulation (A).
[2]The torque exerted on motor an engine at 280° F. is measured.

The preceding table shows that the subject composition was a very effective friction reducing agent at a low concentration, having been at least equivalent to a more expensive friction modifier used in a commercial fuel efficient oil.

By proceeding as in Examples 1 and 2, there are obtained equally effective acetamides having the substituents tabulated below:

| Examples | R | R′ | R″ | R‴ |
|---|---|---|---|---|
| 3 | $C_{12}$ alkyl | $C_8$ alkenyl | H | H |
| 4 | $C_{22}$ alkyl | $C_{10}$ alkyl | H | H |
| 5 | $C_{24}$ alkyl | $C_{12}$ alkyl | methyl | methyl |
| 6 | $C_{22}$ alkenyl | $C_{30}$ alkenyl | butyl | butyl |
| 7 | $C_{30}$ alkenyl | H | phenyl | tolyl |
| 8 | $C_{20}$ alkyl | $C_{20}$ alkyl | $C_{20}$ alkyl | $C_{20}$ alkyl |
| 9 | $C_{15}$ alkyl | H | tolyl | phenyl |
| 10 | $C_{25}$ alkenyl | $C_{25}$ alkenyl | butyl | H |

The compounds of the invention impart friction reduction to a variety of oleaginous compositions including fuels and lubricants when added thereto in an amount ranging from about 0.01 to 5 percent by weight of the fuel or lubricant.

Within its context this invention also contemplates the use of other lubricant and/or fuel additives in combination with the acid amides of this invention. Such other additives include, for example, auxiliary detergents and dispersants, corrosion- and oxidation-inhibiting agents, pour point depressing agents, extreme pressure agents, color stabilizers and anti-foam agents, all incorporated in the amount necessary to fulfill their intended purpose. Many types of these additives are known in the art and any of them are suitable for use in the fuel and/or lubricants of this invention.

Other modes of applying the invention may be employed, change being made as regards the details described, provided the features stated in any of the following claims or the equivalent of such be employed.

What is claimed is:

1. In a lubricant composition comprising a major amount of an oil of lubricating viscosity and containing an alkenyl succinimide, an overbased calcium sulfonate, a polyethoxylated alkylphenol, a zinc dialkyl dithiophosphate, a diarylamine, a polymethacrylate, an olefin copolymer and a silicon antifoamant, each additive being present in an amount to afford its attendant function, the improvement comprising further including a friction-reducing amount of a hydroxyalkoxyacetamide represented by the formula:

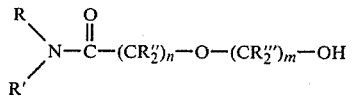

in which R is an alkyl radical having from about 12 to 18 carbon atoms, R′, R″, and R‴ are hydrogen, m is a number from 1 to 10, and n has a value from 1 to 10.

2. A lubricant composition according to claim 1 in which said acetamide is N-oleyl(2′-hydroxy)ethoxy acetamide.

* * * * *